US008317119B2

(12) United States Patent
Wark

(10) Patent No.: US 8,317,119 B2
(45) Date of Patent: Nov. 27, 2012

(54) DOUBLE COURSE VANE WHEEL

(76) Inventor: Rickey E. Wark, Spring, TX (US)

( * ) Notice: Subject to any disclaimer, the term of this patent is extended or adjusted under 35 U.S.C. 154(b) by 337 days.

(21) Appl. No.: 12/878,081

(22) Filed: Sep. 9, 2010

(65) Prior Publication Data

US 2012/0061496 A1 Mar. 15, 2012

Related U.S. Application Data

(63) Continuation-in-part of application No. 12/621,814, filed on Nov. 19, 2009, now abandoned.

(51) Int. Cl.
*B02C 15/00* (2006.01)

(52) U.S. Cl. ..... 241/119

(58) Field of Classification Search ..... 241/117–121
See application file for complete search history.

(56) References Cited

U.S. PATENT DOCUMENTS 4,907,751 A * 3/1990 Wark et al. ..... 241/119
5,090,631 A 2/1992 Wark
5,957,300 A * 9/1999 Nardi et al. ..... 209/143
6,079,646 A * 6/2000 Keyssner et al. ..... 241/47

* cited by examiner

*Primary Examiner* — Faye Francis
(74) *Attorney, Agent, or Firm* — Young Basile Hanlon & MacFarlane PC

(57) ABSTRACT

A double course vane assembly for use in connection with the milling bowl of a pulverizer/classifier. The two courses are either attached to the outer peripheral edge of the milling bowl so as to rotate with the bowl or are attached to the pulverizer/classifier wall so as to remain stationary. In both embodiments, the vane courses are concentric with one another. The vanes in the first course are angled in one sense and the vanes of the second course are angled in the opposite sense.

11 Claims, 5 Drawing Sheets

DOUBLE COURSE VANE WHEEL

RELATED APPLICATION

This application is a continuation-in-part of U.S. application Ser. No. 12/621,814, now abandoned currently pending. The content of the U.S. patent application Ser. No. 12/621,814 is incorporated herein by reference.

FIELD OF THE INVENTION

This invention relates to updraft pulverizer/classifiers and more particularly to a double course vane structure which is either attached to or disposed adjacent the outer perimeter of the milling bowl.

BACKGROUND OF THE INVENTION

Pulverizer/classifiers for crushing coal and ore are well known and are described in my previously granted U.S. Pat. Nos. 4,907,751 and 5,090,631. One popular pulverizer/classifier comprises a milling bowl which rotates about a vertical axis and is contacted by several large spring biased pressure wheels. The material to be pulverized drops onto the center of the bowl and moves radially outwardly toward the crusher wheels. Air passes upwardly through a vane structure which is mounted to or near the outer periphery of the milling bowl. The vane structure includes a plurality of angled vanes mounted between concentric race structures. In the case of a rotating vane structure, the inner race structure is affixed to the outer periphery of the milling bowl. In the case of a stationary vane structure, the outer race is attached to the crusher wall.

The air passing upwardly through the vane structure entrains the crushed material. The lighter, more thoroughly pulverized material travels upwardly out of the housing for use as fuel for a burner in a steam powered turbine. Heavier, less thoroughly pulverized material falls back down toward the milling bowl where it is again contacted by the crusher wheels until the pulverizing function is thorough enough for that material to be carried up and out by the air stream passing through the vane structure.

SUMMARY OF THE INVENTION

The present invention provides an improved vane structure for pulverizer/classifiers of the type described above wherein there are two concentric vane courses mounted to or adjacent the outer periphery of the milling bowl, the vanes in the first course being angled in one sense or direction relative to the axis of rotation while the vanes in the other concentric course are angled in the opposite sense. I have found that this structure improves the mixing action in the air entrained updraft and also causes the heavier, less thoroughly crushed coal or ore particles to fall out of the airstream sooner, thus contributing to the efficiency of the pulverizing function.

In the embodiments hereinafter described in detail, the vane structure comprises three concentric annuli or "races"; an inner race, a middle race and an outer race. A first set of vanes is connected such as by welding between the inner and middle races while a second set of vanes is connected between the middle and outer races. As stated above, the first set of vanes is angled, preferably at approximately 45° to the vertical, in one sense while the vanes in the adjacent outermost set are angled to essentially the same degree but in the opposite sense. In the rotating vane embodiment, an arcuate "seal" plate is attached to the upper outer periphery of the outer race such that it lies in close proximity to a deflector structure which is radially outboard of the race structure and attached to the inner sidewall of the pulverizer/classifier housing. In the stationary vane embodiment, the vane structure is attached to the crusher housing inner wall.

The foregoing and following descriptions of the invention are to be taken with accompanying drawings which describe illustrative embodiments of the invention in detail.

BRIEF DESCRIPTION OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
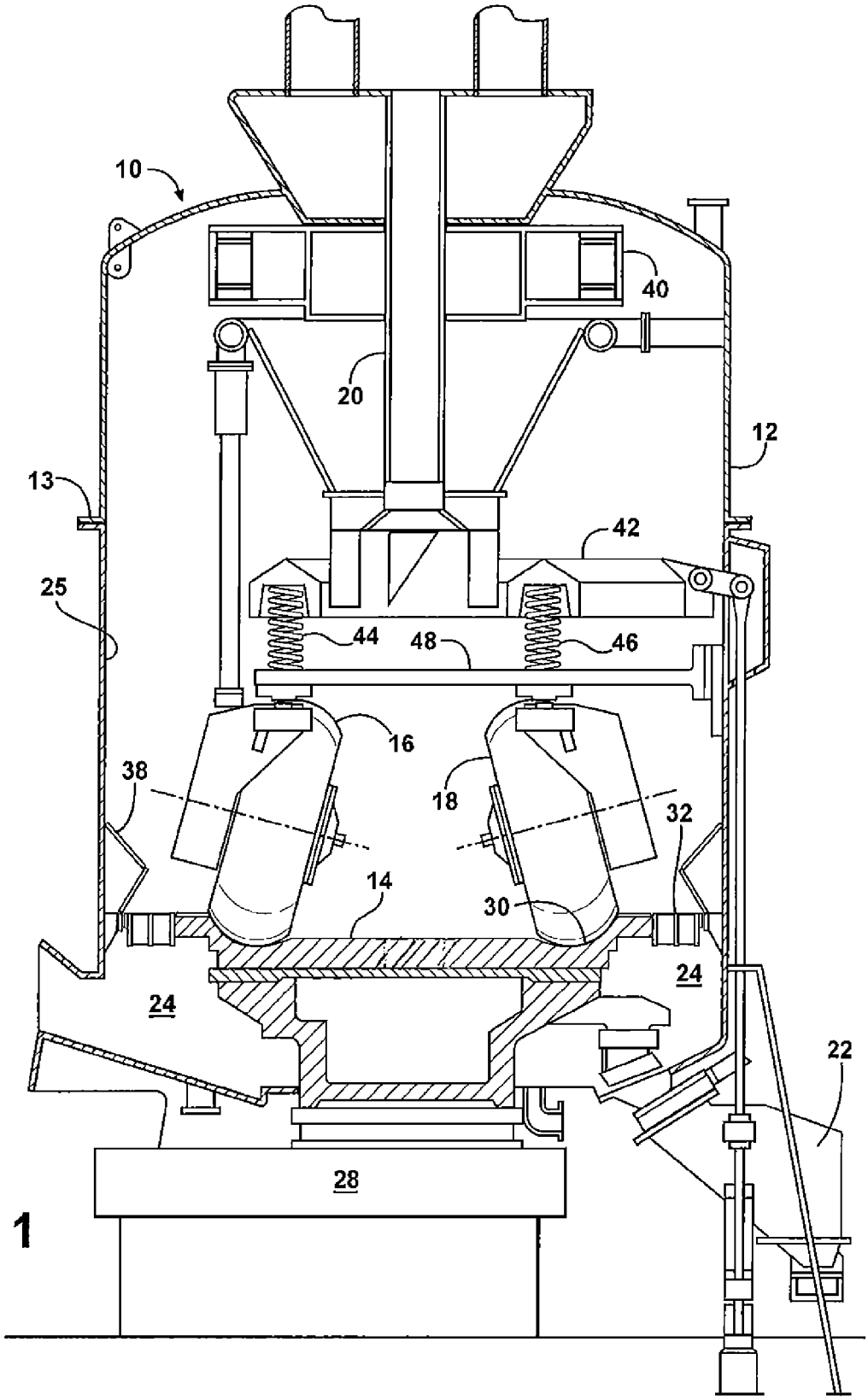
FIG. 1 is a somewhat simplified, cross-sectional drawing of a representative pulverizer/classifier for coal and other ore materials wherein the invention race structure is shown attached to the outer periphery of the milling bowl.

FIG. 1 shows in cross-section a pulverizer/classifier which is typically referred to as a "rotating throat" updraft pulverizer/classifier 10. The pulverizer/classifier 10 comprises an upright steel housing 12, a substantially horizontal rotatable milling bowl 14, the upper surface of which is contacted by a plurality of spring suspended crusher wheels 16, 18 to pulverize lump particulate material such as coal which is loaded into the housing by means of a vertical chute 20 aligned with a longitudinal vertical axis of the housing 12. Air is supplied to the housing 12 by means of a turbine and duct system 22, connected into a lower chamber 24 and forced to flow upwardly within the housing 12 around the outer periphery of the bowl 14 so as to pass through a double course vane structure 32 immediately adjacent a stationary deflector structure 38 which is attached to the inner surface 24 of the housing sidewall. The bowl 14 sits in a heavy steel turret which is driven so as to rotate about a vertical longitudinal axis by a motor and suitable reduction gears in a housing 28.

Figure 2:
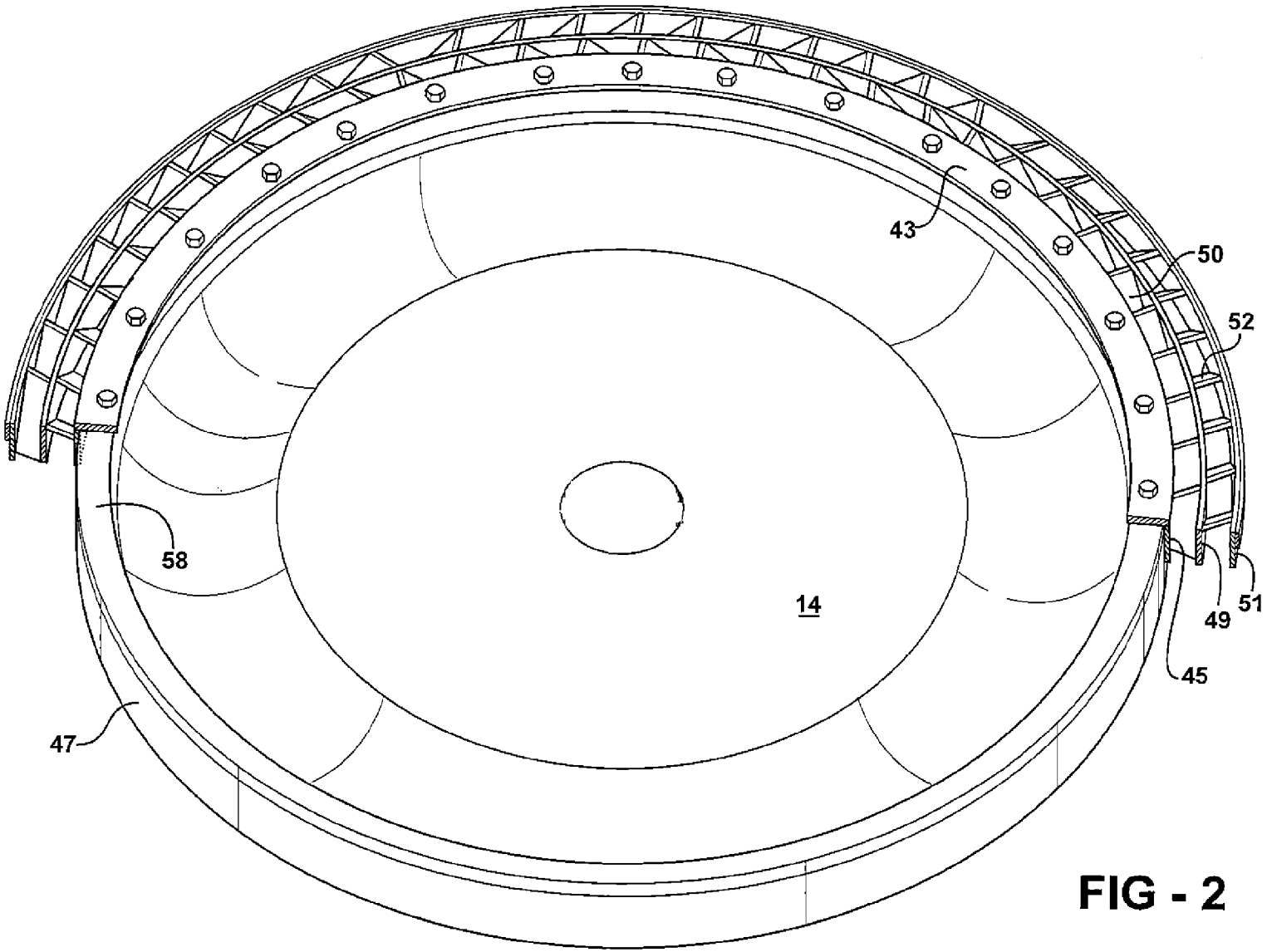
FIG. 2 is a detailed drawing, with parts broken away to show sectional details, of the milling bowl and the race structure from the pulverizer/classifier of FIG. 1.
Figure 3:
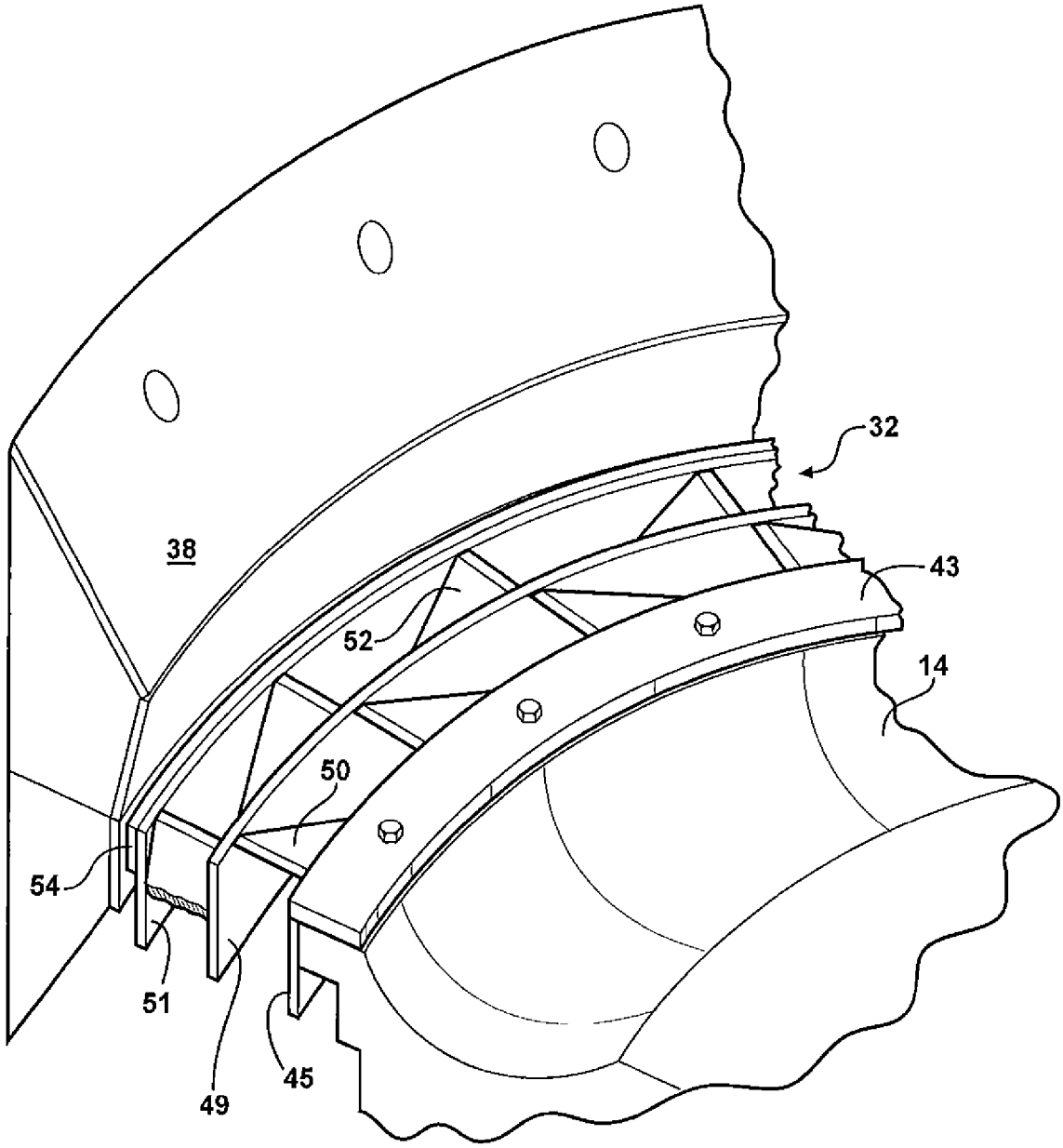
FIG. 3 is a perspective view of a portion of a milling bowl showing the race structure and a deflector.

In operation, the coarse particulate material is dropped through the chute 20 onto the center of the bowl 14 and moves by centrifugal force outwardly onto surface 30 which is contacted by the crusher wheels 16, 18. Crushed material of various sizes and density moves farther outwardly toward the peripheral vane structure 32, the details of which are hereinafter described with reference to FIGS. 2 through 4. The vane structure 32 is attached to and rotates with the bowl 14 within the housing 12. The airstream carries crushed material toward a classifier structure 40 which causes heavier, larger particles to fall back downwardly toward and onto the surface of the bowl 14 where they are again treated by the rollers 16, 18. Even heavier particles never reach the classifier and fall quickly back to the bowl 14.

A heavy head structure 42 mounted within the housing by conventional apparatus receives springs 44, 46 to bear against a carrier structure 48 which applies a downward force to the crusher wheels 16, 18 in a known manner. Additional detail with respect to the structure and operation of the pulverizer/classifier 10 can be attained from the aforementioned U.S. Pat. No. 4,907,751. It will be understood that this is representative of a single type of pulverizer/classifier and that other types of classifiers using, for example, different suspension systems for the crusher wheels are known in the art.

Figure 4:
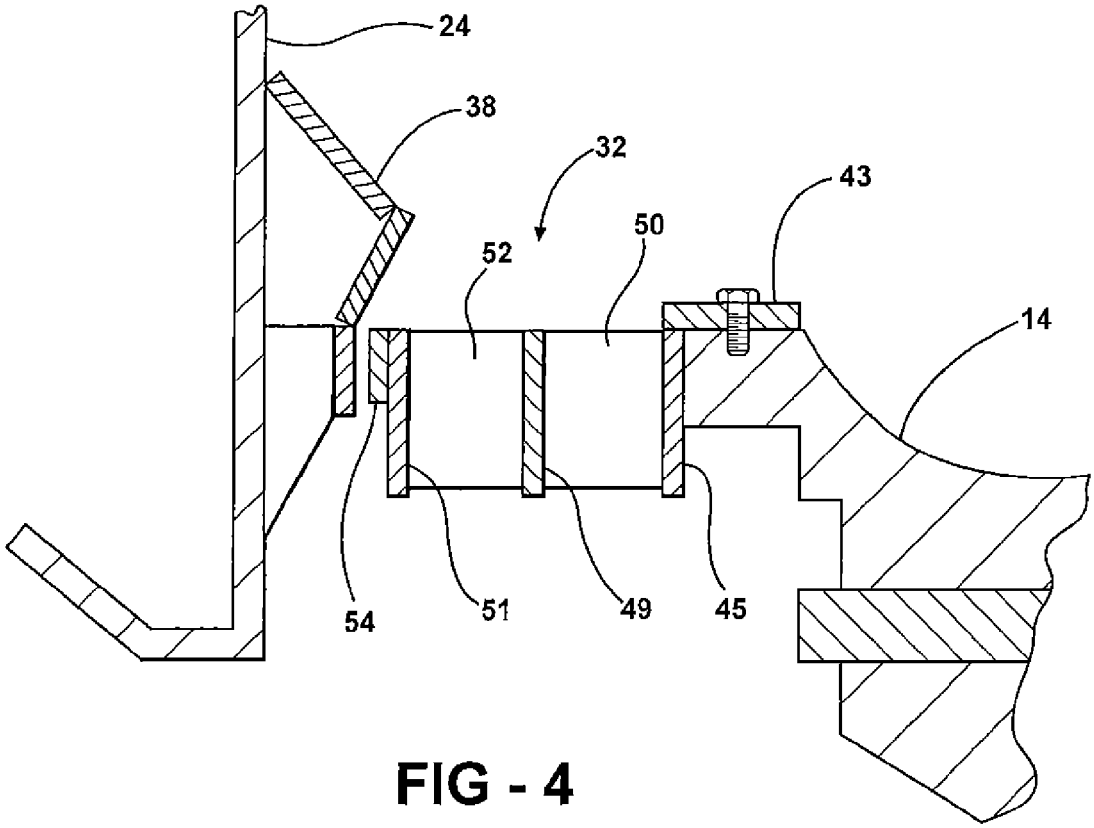
FIG. 4 is a more detailed cross-sectional view of a representative portion of the bowl and race structure in the embodiment of FIG. 2.
Figure 5:
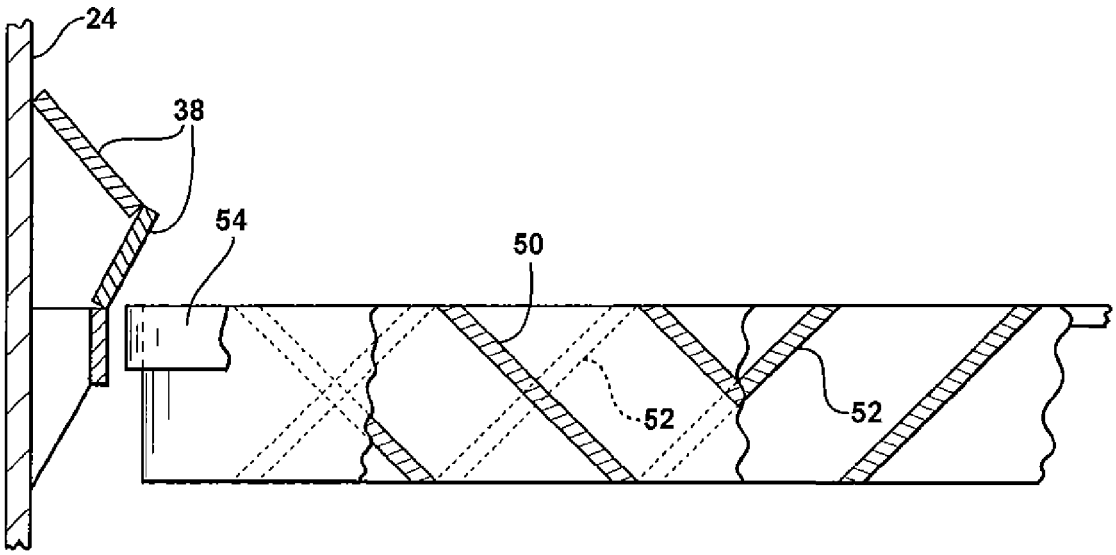
FIG. 5 is a side view of a section of a race structure showing a spatial relationship between the inner and outer race vanes in the illustrative embodiment.

Referring now to FIGS. 2 through 5, the milling bowl 14 is shown to have a flat top edge 58 near the outer periphery although some milling bowls have stepped edges. A plate 43 is bolted to the top edge 58. An annular inner race 45 is bolted to the peripheral face 47 of the milling bowl 14 and welded to the top plate 43 as shown. The vane structure 32 further comprises a middle race 49 concentric with the inner race 45 and an outer race 51 which is concentric with the middle race 49 and the inner race 45. The races 45, 49, 51 are radially spaced from one another and vanes 50 are welded at regular intervals between the races 45, 49 at a 45° angle from vertical. A second set of vanes 52 is welded at regular intervals between the races 49, 51 and also angled at 45° from the vertical but opposite in sense to the vanes 50 as best shown in FIG. 4. When viewed from the side, the vanes 52 cross the vanes 50. The spacing between the vanes in both sets is such that the top or leading edge of one vane is directly over the bottom or trailing edge of the next vane in the series. A seal plate 54 is welded to the outside of the outer race flush with the topmost edge thereof. In the finished assembly, the seal plate 54 is closely adjacent the vertical surface of the deflector structure 38 immediately outboard of the vane structure 32 so as to prevent all but a small amount of air flow between the vane structure 32 and the deflector 38.

In practice, the vane structure can be assembled in a retrofitting operation by removing the original single-course vane wheel and replacing it in segments. Each segment is attached to the bowl 14 and welded to the last-installed segment one segment at a time, to the milling bowl 14 beginning with the attachment of the inner race segments and working outward. The entire race assembly 32 may be replaced as necessary by releasing the bolts which tie it to the milling bowl 14 and separating the segments as necessary. Of course, the double-course vane assembly may be part of an OEM installation as well. Alternatively, the top of the pulverizer housing 12 can be removed at the seam 13 to allow a complete vane wheel structure 32 to be lowered into place and bolted or welded to the pulverizer bowl or to the inside of the housing if it is to be stationary.

Figure 6:
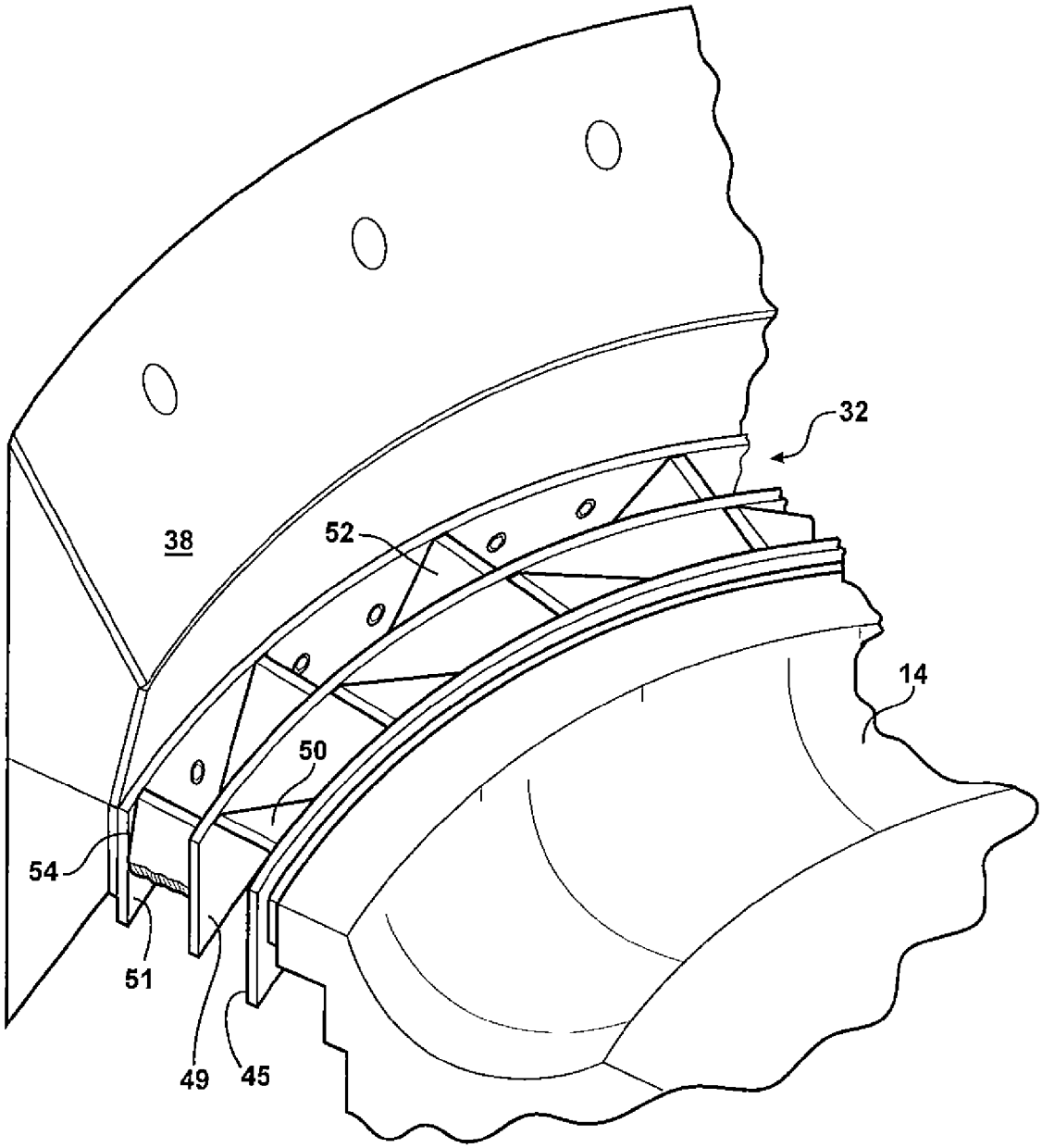
FIG. 6 is a partial perspective drawing of a second embodiment wherein the vane structure is attached to the housing wall.

FIG. 6 shows a second embodiment also having two courses of vanes 50, 52 welded between concentric races 45, 49, 51. However, the inner race 45 is not attached to the bowl 14 and does not rotate. The outer race 51 is attached to the interior wall of the crusher via the deflector 38.

It will be understood that the various surfaces of the vanes 50, 52 which are most consistently impacted by the material being pulverized are treated for wear by welding any of various carbides and/or alloys thereto or, in the case of the top plate 43, constructing the entirety of that plate out of a highly wear resistant material. It is also possible, but not preferred, to attach one vane course to the bowl 14 and the other to the crusher housing so that the two courses move relative to one another.

What is claimed is:

1. In combination:

a crusher bowl having a circular outer periphery;

a vane structure comprising first and second courses of angled vanes arranged around the periphery of said bowl; the vanes in the first course being angled in a sense opposite to the vanes in the second course.

2. The combination of claim 1 wherein the vane courses are attached to the bowl.

3. The combination of claim 1 wherein the vane courses are spaced from the bowl periphery.

4. A method of retrofitting a pulverizer of the type having a milling bowl with a single course vane wheel comprising the steps of:

removing the single-course vane wheel and, thereafter, installing a double-concentric-course vane wheel on or adjacent to the outer periphery of the milling bowl.

5. A vane assembly for use in an updraft pulverizing mill comprising:

a first annular course of vanes having an axis of symmetry and comprising circumferentially spaced apart vanes arranged around said axis and angled in a first sense relative to said axis of symmetry; and a second annular course of circumferentially spaced vanes coaxial with and affixed radially adjacent to the first course of vanes, said second course of vanes being arranged around said axis of symmetry and angled in a sense opposite the vanes in the first course.

6. A vane assembly as defined in claim 5 further comprising an inner race and, concentric therewith, a middle race and an outer race, the first annular course of vanes being mounted between the inner and middle races, the second annular course of vanes being mounted between the middle and outer races.

7. A milling bowl/vane assembly combination comprising:

a milling bowl having an axis of rotation a double-course vane assembly attached to the outer periphery of said bowl for rotation therewith, said vane assembly further comprising:

a first annular course of circumferentially spaced vanes wherein each vane is angled in a first sense relative to said axis; and a second annular course of circumferentially spaced vanes coaxial with and radially affixed to the first course of vanes so as to rotate therewith wherein each vane in said second course is angled in a sense opposite the vanes in the first course.

8. A milling bowl/vane assembly combination as defined in claim 7 wherein the vane assembly comprises inner, middle and outer races, all of which are concentrically oriented and radially spaced from one another, the inner race being mounted to the periphery of the milling bowl, the first said vanes being mounted between the inner and middle races, the second set of vanes being mounted between the middle and outer races.

9. A milling bowl/vane assembly combination as defined in claim 8 further comprising a seal plate attached to the outer surface of the outer race.

10. A milling bowl/vane assembly combination as defined in claim 8 further comprising annular top plate attached to the inner race and orthogonal thereto, the said top plate being removably mounted to the milling bowl.

11. An updraft bowl mill comprising:

a housing;

a milling bowl mounted in the housing;

a vane structure mounted in the housing in concentric, surrounding relation to the bowl mill; said vane structure comprising a first annular vane course and, concentrically adjacent thereto a second annular vane course; each course comprising a series of spaced-apart, angled vanes for redirecting air flow through the course, the vanes of the first course being angled oppositely to the vanes in the second course.

* * * * *